United States Patent [19]

Lundstrom et al.

[11] Patent Number: 4,960,047

[45] Date of Patent: Oct. 2, 1990

[54] TOPPING FOIL LOADING MECHANISM AND METHOD

[75] Inventors: Robert W. Lundstrom, Plymouth; Robert A. Sells, Minneapolis, both of Minn.

[73] Assignee: DataCard Corporation, Minneapolis, Minn.

[21] Appl. No.: 276,380

[22] Filed: Nov. 23, 1988

[51] Int. Cl.[5] ..... B44C 1/14

[52] U.S. Cl. ..... 101/27; 101/426; 101/485; 226/91; 226/92; 156/233; 156/540

[58] Field of Search ..... 101/27; 226/89, 91, 226/92; 156/540, 541, 542, 502, 235, 233; 400/196.1; 242/58.1, 58.4, 58.5

[56] References Cited

U.S. PATENT DOCUMENTS

| | | | |
|---|---|---|---|
| 1,155,573 | 10/1915 | Hooley | 101/336 |
| 1,580,671 | 4/1926 | Nichols | 118/63 |
| 2,120,679 | 6/1938 | Pohle | 101/3.1 |
| 2,604,387 | 7/1952 | Mintz | 101/301 |
| 3,124,064 | 3/1964 | Schick | 101/18 |
| 3,417,695 | 12/1968 | Peters | 101/407.1 |
| 3,430,557 | 3/1969 | Peters | 101/27 |
| 3,612,539 | 10/1971 | Bragas | 226/91 X |
| 3,669,014 | 6/1972 | Spaw et al. | 101/3.1 |
| 4,194,944 | 3/1980 | Spätle | 156/540 |
| 4,668,328 | 5/1987 | Kyytsönen | 242/58.4 X |
| 4,695,850 | 9/1987 | Nubson | 346/76 PH |
| 4,700,642 | 10/1987 | Hankinson, Jr. | 242/58.4 X |

*Primary Examiner*—Michael W. Ball
*Assistant Examiner*—Michele K. Yoder
*Attorney, Agent, or Firm*—Merchant, Gould, Smith, Edell, Welter & Schmidt

[57] ABSTRACT

A foil loading apparatus (12) includes a foil lift mechanism (14) and a guide plate (20) for advancing foil material (16) along a winding foil flow path. Foil material (16) is raised on lift arm (24) from a lower position up through a confined space between a heated platen (40) and a pressing block (42) to an upper position where the foil material (16) may be accessed and fed through a remaining portion of the foil flow path.

25 Claims, 3 Drawing Sheets

TOPPING FOIL LOADING MECHANISM AND METHOD

BACKGROUND OF THE INVENTION

The present invention relates to loading and threading foil material or ribbon material into a threadable mechanism. In particular, the present invention relates to positioning of the foil material after passing through a portion of a flow path of a topping mechanism so that it can be hand threaded through a remainder of the flow path.

In mechanisms requiring threading a film or foil material through a complex flow path, generally the material must be threaded under a lower guide and up and around an upper guide at some point in the flow path. In a topping operation in which foil is placed on the raised letters of a plastic card, a first problem arises when attempting to direct the foil material under a lower guide. The mechanism's configuration may cause the foil material to bunch up and clog, requiring another attempt to thread the material. Problems may also arise when moving the ribbon material from the lower position up through cramped spaces to an upper position in the winding flow path. Limited spaces, sharp points and edges, and heated elements frequently make the task particularly troublesome. The limited space is often too small to reach through by hand, necessitating other means of threading the foil or ribbon material. In such instances, prior foil advancing methods required pivoting the mechanism up for access, inserting additional foil guides, or resorting to a wand or stick to raise the foil material. A further advance was placing tape or glue at the end of the stick to pick up the foil material. This method is unsatisfactory, as a stick or wand is difficult to manipulate, causing problems in picking up the foil material, often requiring substantial time. Using a stick with tape or glue at one end may also damage the mechanism or tear and scratch the fragile foil material.

It is evident that an improved apparatus for advancing foil material along certain winding points in a flow path is needed. The present invention addresses these problems providing an easy method of loading the foil material into proper position in the flow path, and providing relatively safe handling of the foil or ribbon material. The present invention solves these and other problems associated with foil or ribbon loading and threading.

SUMMARY OF THE INVENTION

The present invention relates to a loading apparatus and method for loading foil or ribbon material through a portion of a foil flow path to a position where the material may be easily fed through the remainder of the flow path. The present invention raises the foil material from a lower position to an upper position where access to the foil material is more easily gained and the foil material is more easily handled for further threading.

In the present invention, a reel of foil material is unwound and fed down a guide plate toward a foil lift mechanism. The lift mechanism comprises a handle grip mounted at an upper end of a handle shaft and an arm affixed to the lower end of the handle shaft. The lift mechanism is suitably mounted on a rail providing for sliding up and down the rail. A sloping foil guide plate directs the unreeling foil down from a supply reel onto the lift mechanism. The guide plate threads the foil material under a lower guide and onto the lift arm in its rest position. If a sufficient quantity of material has been unreeled, a length of foil material will rest beyond the lift arm so that the lift arm will engage the foil material. Sufficient foil or ribbon material must be unwound to leave a length of the material hang over the lift arm so that when the handle attached to the lift arm is pulled upward, the weight and length of the extra material will be sufficient so that the material does not fall off the lift arm; excess unreeled material does not cause a problem, since the excess can be easily pulled up between a heated platen and pressing block and threaded through the rest of the flow path. The foil path leads the foil under the lower guide and up and over a second upper guide, substantially above the lower guide.

For threading, the lift mechanism is at its lowest resting position, the foil feeds from the supply reel down under the lower guide along the guide plate until it hangs over the lift arm. The lift arm is then pulled by the upper handle up between the platen and pressing block to a position wherein the foil material is readily grasped and hand fed over the upper guide. The lift arm is lowered to the resting position where the lift mechanism is out of the way of the operation of the topping mechanism and flow path of the foil. The foil material is easily threaded through the remainder of the flow path and wound around a take-up reel and is ready for topping operation.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings wherein like reference numerals and letters indicate corresponding elements throughout the several views.

DETAILED DESCRIPTION OF THE PREFERRED EMBODIMENTS

Figure 1:
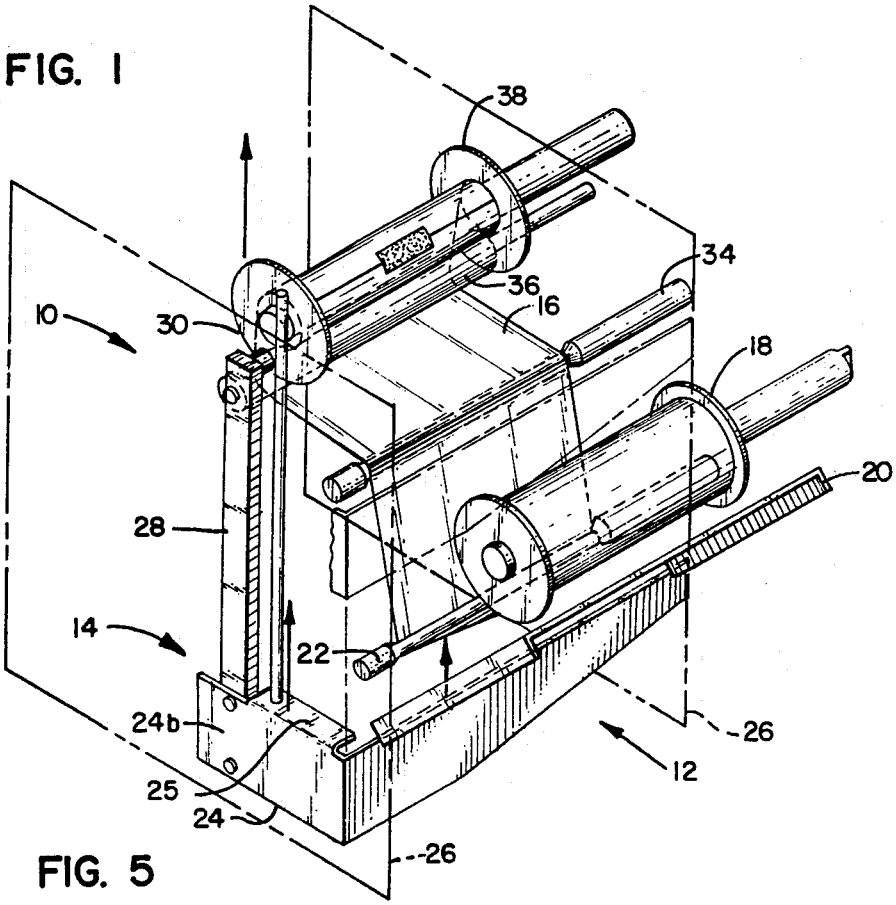
FIG. 1 is a perspective view with parts removed illustrating an embodiment of a foil topping mechanism and a topping foil loading apparatus in accordance with the principles of the present invention.

FIG. 1 is a perspective view with parts removed of an embodiment of a topping mechanism implementing an embodiment of a foil loading apparatus in accordance with the principles of the present invention, the topping mechanism being generally designated by the reference numeral 10 and the foil loading apparatus being generally designated by the reference numeral 12. Topping mechanisms are typically used for depositing pigment on raised lettering on plastic cards. A heated platen presses the pigmented topping foil against the raised lettering. The topping foil is then peeled away, leaving pigment on the raised letters.

The topping mechanism 10 includes the topping foil loading apparatus 12 for loading foil material 16 from a supply reel 18. The topping mechanism 10 requires a winding flow path for the foil material 16 and implements the foil loading apparatus 12 including a foil lift mechanism 14 and a foil guide plate 20 of the present invention.

Figure 5:
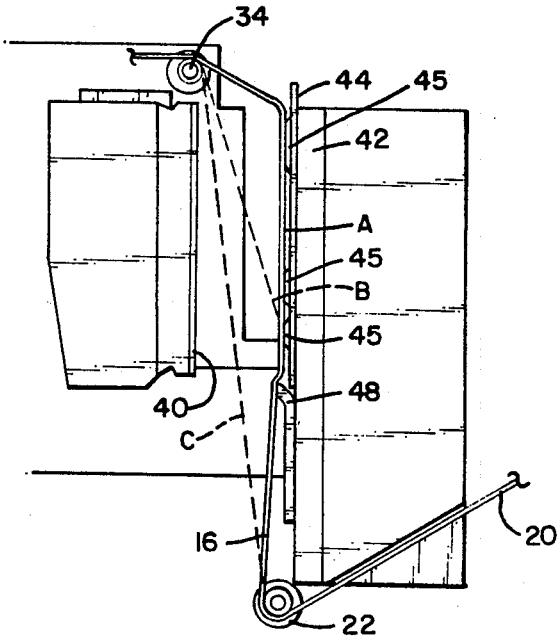
FIG. 5 is an elevational view of a detail of a portion of the topping mechanism shown in FIG. 1 illustrating the platen and the pressing block, and the foil material in several stages of the topping operation shown in phantom; and, FIG. 6 is a perspective view of a detail of the foil lift arm guides engaging the vertical rail and guides of the foil loading apparatus shown in FIG. 1.

In FIG. 5, the topping operation is shown with a detail of the narrow difficult to thread vertical portion of the flow path. The foil material 16 passes under a lower guide 22 up through a narrow area between a heated platen 40 and a pressing block 42 and over an upper guide 34. A card 44 having raised letters 45 is held with its back against the pressing block 42 so that the foil material 16 passes in front of the face of the card 44. Upon actuation, the platen 40 presses the foil 16 against the raised letters 45 as shown at A. When the platen 40 is pulled back, the foil 16 remains adhered to the letters 45 as shown. The foil 16 is then pulled along the foil path, stripping the foil 16 from the card 44 as shown at B, leaving pigment only on raised lettering 45 of the card 44. A foil strip plate 48 holds the card 44 during stripping of the foil 16 from the card 44. When the foil 16 has been completely stripped from the card 44, the foil 16 returns to its original flow path as shown at C. It is readily appreciated that the narrow area between the heated platen 40 and the pressing block 42 requires the aid of the foil loading apparatus 12 including a foil guide plate 20 and a foil lift mechanism 14 for threading the foil material 16.

Figure 2:
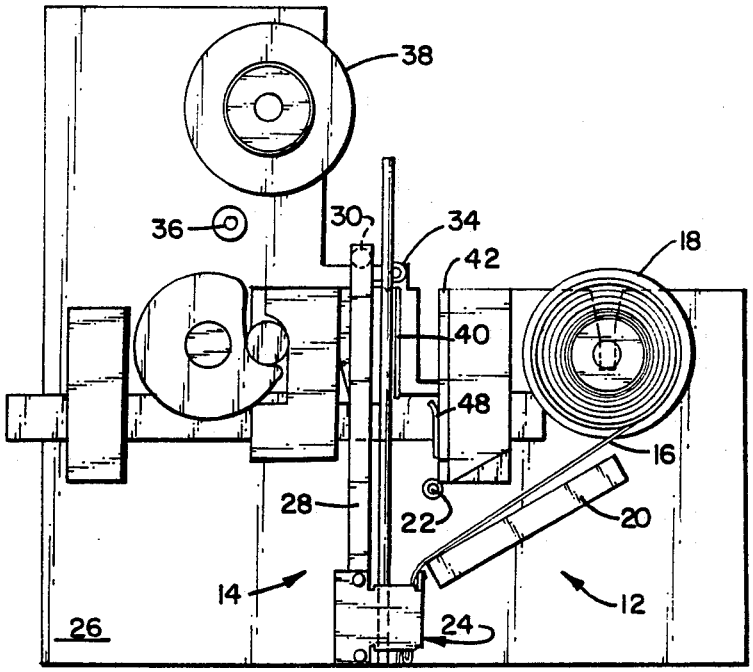
FIG. 2 is an elevational view of the topping foil mechanism shown in FIG. 1 illustrating the topping foil unwound from a supply reel and fed down along a guide plate and over a lift arm in its rest position.
Figure 6:
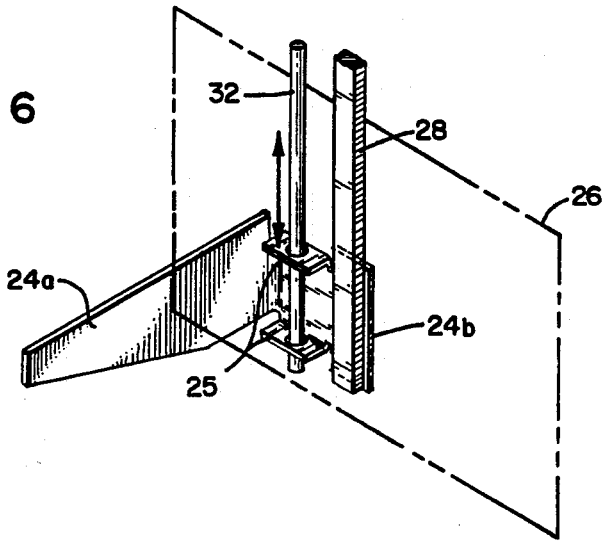

FIG. 2 shows an elevational view of the topping mechanism 10. A portion of the foil material 16 has been unwound and fed to the foil lift mechanism 14. To load and thread the foil material 16, the supply reel 18 is placed in its operating position and unreeled so that the foil material 16 drops onto the foil guide plate 20. The guide plate 20 slopes and directs the foil material 16 under the lower guide 22 as required by the foil flow path and onto the foil lift mechanism 14. The foil lift mechanism 14 includes an L-shaped lift arm 24 having an elongated portion **24*a* with a substantially pointed crest extending transversely of and below the foil flow path, and a side plate 24*b* at a substantially right angle to the elongated transverse member 24*a*. The lift arm 24 is pulled upwards by lifting a handle grip 30 at an upper end of a vertical handle shaft 28 attached to the side plate 24*b* of the lift arm 24. In the embodiment shown, the handle grip 30 extends transversely of the foil path into the plane of FIG. 2. Additionally, the handle grip 30 is disposed above the platen 40 and pressing block 42 even when in a lower, at rest position. As shown in FIG. 6, the lift mechanism 14 is slidably mounted at the side plate 24*b* of the lift arm 24 by guides 25 enclosing vertical rail 32 for directing the handle shaft 28 and the lift arm 24 along the lifting path of the foil material 16** between a lower, at rest position and an upper, foil feeding position.

The outside of the side plate **24*b* abuts the inside of a side wall of topping mechanism frame 26. The position of the side plate 24*b* relative to the side of frame 26 prevents the lift arm 24 from rotating about the vertical rail 32**.

Figure 3:
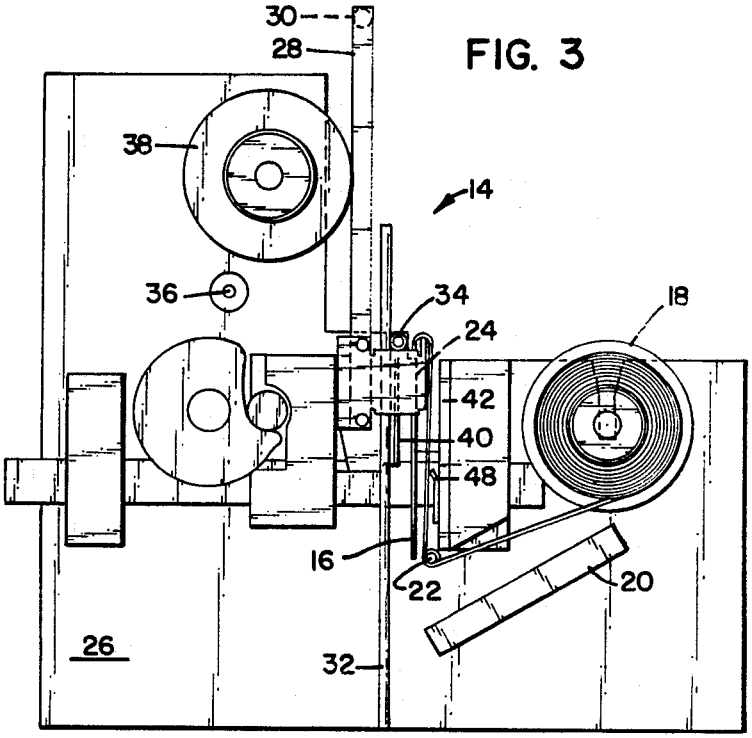
FIG. 3 is an elevational view of the foil topping mechanism shown in FIG. 1 illustrating the foil unwound and fed over the lift arm and lifted into an upper position wherein foil material can be accessed.
Figure 4:
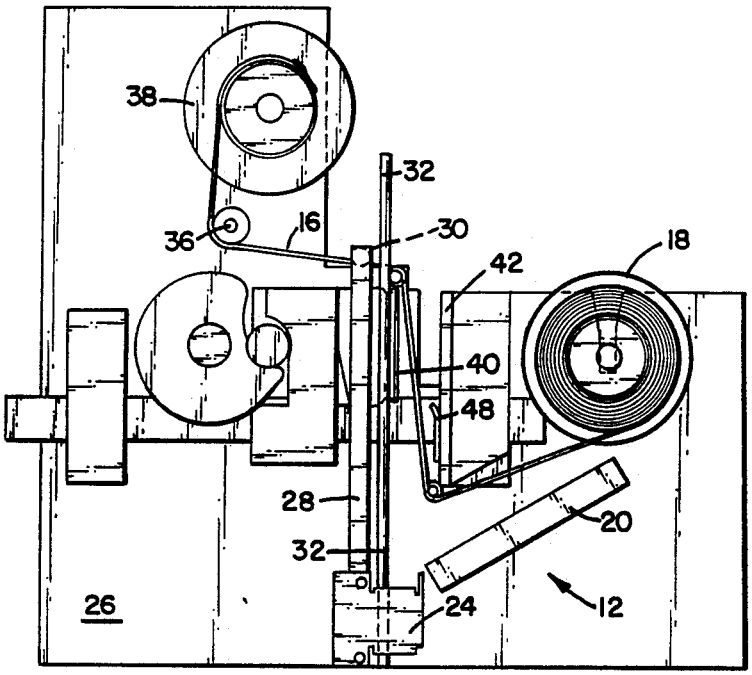
FIG. 4 is an elevational view illustrating the foil topping mechanism with the foil completely fed through the foil flow path and onto a take-up reel, the lift mechanism being lowered to its rest position.

For threading the foil material 16, when a sufficient amount of foil material 16 has been unreeled, the foil material 16 drops off the supply reel 18 down guide plate 20 and over the elongated portion **24*a* of the lift arm 24. The supply reel 18 is unreeled until a sufficient length of foil material 16 overhangs the lift arm 24 in the lower, at rest, position so that upon movement of the lift mechanism 14 between the platen 40 and pressing block 42 into an upper position, the pointed upper crest of the elongated portion 24*a* of the lift arm 24 engages the underside of the foil material 16 and the foil material 16 is raised with the lift arm 24 without falling off. Upon actuation of the handle grip 30 in an upward motion, the foil lift mechanism 14 raises the foil 16 by engaging the foil 16 with lift arm 24 and moving it upwards. A sufficient length of excess foil material 16 must be fed beyond the elongated portion 24*a* of the lift arm 24 so that when the lift arm 24 is raised, the weight of the hanging excess foil keeps the foil material 16 from falling off of the lift arm 24 upon rising to the upper position. When in an upper position as shown in FIG. 3, the foil 16 is taken off the lift mechanism 14 and hand threaded over upper guide 34 located above platen 40 and through the remainder of the flow path under a third guide 36 and onto an empty foil take-up reel 38 as shown in FIG. 4. The lift arm 24 is lowered back into a rest position so that the vertical slide rail 32 and the lift mechanism 14 remain out of the way of the foil flow path and topping operations. It will be appreciated from the above description that the embodiment of the foil mechanism 14 of the present invention described allows access to the foil 16 for threading purposes without the operator having to reach down into the confined space between the heated platen 40 and the pressing block 42**.

It is to be understood that even though the above numerous characteristics and advantages of the invention have been set forth in the foregoing description, together with the structure and function of the invention, the disclosure is illustrative only, and changes may be made in detail, especially in matters of shape, size and arrangement of parts and the principles of the invention, to the full extent indicated by the broad, general meaning of the terms in which the appended claims are expressed.

What is claimed is:

1. A foil material loading apparatus used in threading an end of a reel of foil material from a supply reel along a foil flow path through a topping mechanism and onto a take-up reel comprising:

(a) foil lift arm means for engaging an underside of the foil material so that when a length of foil material is advanced over the lift arm, the weight of the foil material acts to counterbalance the resistance of the foil material attached to the supply reel so that the foil material remains hanging on the lift arm when raised;

(b) handle means connected to the foil lift arm means, for raising the foil lift arm means so that the foil material is raised along with the foil lift arm means from a lower position to an upper position along the foil flow path; and (c) rail means for slidably guiding the foil lift arm means into the upper position along the foil flow path.

2. An apparatus according to claim 1, further comprising guide ramp means sloping down from below the supply reel for directing foil material unreeled from the supply reel downward and under a lower guide and over the foil lift arm means.

3. An apparatus according to claim 1, wherein the handle means is situated to one side of the foil flow path so as not to interfere with the flow of the foil material or the operation of the topping mechanism.

4. An apparatus according to claim 1, wherein the foil lift arm means includes an elongated lift arm member extending transversely across and below the path of the foil material.

5. An apparatus according to claim 4, wherein the lift arm member has a substantially pointed crest.

6. An apparatus according to claim 1, wherein the lift arm means comprises an L-shaped member having a side plate and an elongated member extending transversely across the foil material path, the elongated member mounted at a substantially right angle to the side plate, the side plate sliding along the rail means.

7. An apparatus according to claim 6, wherein the rail means comprises a vertical member and guides secured to the side plate, the guides slidably engaging the vertical member providing for movement of the foil lift arm means along the vertical member from the lower position to the upper position.

8. A foil material loading apparatus used in loading foil material from a supply reel along a foil flow path through a topping mechanism and onto a take-up reel comprising:

(a) foil lift arm means for engaging an underside of the foil material such that the weight of the foil material acts to counterbalance the resistance of the foil material attached to the supply reel;

(b) handle means disposed above and connected to the foil lift arm means, for raising the foil lift arm means so that the foil material is raised along with the foil lift arm means from a lower position to an upper position along the foil flow path;

(c) rail means slidably engaging the foil lift arm means for slidably guiding the foil lift arm means into the upper position along the foil flow path; and (d) guide ramp means sloping down from below the supply reel for directing foil material unreeled from the supply reel downward and under a lower guide and over the foil lift arm means when the foil lift arm means is in the lower position.

9. An apparatus according to claim 8, wherein the handle means is situated to one side of the foil flow path so as not to interfere with the flow of the foil material or the operation of the topping mechanism.

10. An apparatus according to claim 8, wherein the foil lift arm means includes an elongated lift member extending transversely across and below the path of the foil material.

11. An apparatus according to claim 10, wherein the elongated lift member has a substantially pointed crest.

12. An apparatus according to claim 8, wherein the lift arm means comprises an L-shaped member having a side plate and a lift member extending transversely across the foil material path, the lift member mounted at a substantially right angle to the side plate, the side plate sliding along the rail means.

13. An apparatus according to claim 12, wherein the rail means comprises a vertical member and guides secured to the side plate, the guides slidably ,engaging the vertical member providing for movement of the lift arm means along the vertical member from the lower position to the upper position.

14. A topping mechanism including a topping foil loading apparatus for feeding topping foil from a supply reel to a take-up reel along a predetermined foil feed path, the topping foil being fed between a heatable platen and a pressing block member of the topping mechanism, the topping mechanism comprising:

(a) a frame supporting a first guide located below the heatable platen and a second guide located above the heatable platen, the first and second guides cooperating to guide the topping foil between the heatable platen and the pressing block member;

(b) topping foil lift means movable between a lower position and an upper position for lifting the topping foil between the heated platen and the pressing block member from a lower first position proximate the first guide to an upper second position proximate the second guide along the foil feed path, the topping foil lift means including a lift arm member extending transversely of the topping foil below an underside of the topping foil and a handle member interconnected to the lift arm member by an elongated vertically extending shaft, whereby the handle member is accessible to the operator even when the topping foil lift means is in the lower position; and (c) guide ramp means sloping downward from below the supply reel for directing the topping foil over the lift arm member when the lift means is in the lower position.

15. A topping mechanism according to claim 14 including rail means slidably engaging the lift arm member for guiding the foil lift means between the lower position and the upper position.

16. A topping mechanism according to claim 14, wherein the lift arm means includes an L-shaped member having a side plate and a lift member extending transversely across the foil material path, the lift member mounted at a substantially right angle to the side plate, the side plate sliding along the rail means.

17. A topping mechanism according to claim 16, wherein the rail means comprises a vertical member and guides secured to the side plate, the guides slidably engaging the vertical member providing for movement of the lift arm member along the vertical member from the lower position to the upper position.

18. A topping mechanism according to claim 17, wherein the outer surface of the side plate abuts the frame of the topping mechanism, preventing rotation of the lift arm member about the rail means.

19. A method for loading foil material into a threadable mechanism along a foil material flow path, comprising the steps of:

(a) advancing a length of foil material from a supply reel onto a lift arm so that the foil material engages the lift arm such that the weight of the foil material acts to counterbalance the resistance of the foil material attached to the supply reel and the end of the foil material may be lifted up to an accessible position for threading through the mechanism, (b) raising the lift arm by grasping a handle member attached to the lift arm, thereby engaging the underside of the foil material and lifting the foil material to a higher position where the end of the material may be manually accessed for continued threading; and (c) feeding the lifted foil material from the raised lift arm through the rest of the foil material flow path to a take-up reel.

20. A method according to claim 19, wherein weight of the foil material is used to advance the foil material down the guide ramp and over the lift arm.

21. A method for advancing an end of a reel of foil material into a threadable mechanism along a foil material flow path with a foil lift arm, comprising the steps of:

(a) advancing an end of a length of the foil material so that sufficient length of foil material hangs over the lift arm and engages the lift arm so that the weight of the foil material acts to counterbalance the resistance of the foil material attached to the supply reel and the foil material will not fall off the lift arm upon raising the lift arm from a lower position to an upper position;

(b) raising the lift arm so that the lift arm engages the underside of the foil material and lifts the foil material to a higher position wherein the foil material may be accessed; and (c) feeding the end of the foil material through the remainder of the foil material flow path.

22. A foil material loading apparatus used in loading foil material from a supply reel along a foil flow path through a topping mechanism and onto a take-up reel comprising:

(a) foil lift arm means for engaging an underside of the foil material;

(b) handle means connected to the foil lift arm means, for raising the foil lift arm means so that the foil material is raised along with the foil lift arm means from a lower position to an upper position along the foil flow path; and (c) rail means for slidably guiding the foil lift arm means into the upper position along the foil flow path, wherein the lift arm means comprises an L-shaped member having a side plate and an elongated member extending transversely across the foil material flow path, the elongated member mounted at a substantially right angle to the side plate, the side plate sliding along the rail means.

23. An apparatus according to claim 22, wherein the rail means comprises a vertical member and guides secured to the side plate, the guides slidably engaging the vertical member providing for movement of the foil lift arm means along the vertical member from the lower position to the upper position.

24. A foil material loading apparatus used in loading foil material from a supply reel along a foil flow path through a topping mechanism and onto a take-up reel comprising:

(a) foil lift arm means for engaging an underside of the foil material;

(b) handle means disposed above and connected to the foil lift arm means, for raising the foil lift arm means so that the foil material is raised along with the foil lift arm means from a lower position to an upper position along the foil flow path;

(c) rail means slidably engaging the foil lift arm means for slidably guiding the foil lift arm means into the upper position along the foil flow path, wherein the lift arm means comprises an L-shaped member having a side plate and a lift member extending transversely across the foil material path, the lift member mounted at a substantially right angle to the side plate, the side plate sliding along the rail means; and (d) guide ramp means sloping down from below the supply reel for directing foil material unreeled from the supply reel downward and under a lower guide and over the foil lift arm means when the foil lift arm means is in the lower position.

25. An apparatus according to claim 24, wherein the rail means comprises a vertical member and guides secured to the side plate, the guides slidably engaging the vertical member providing for movement of the lift arm means along the vertical member from the lower position to the upper position.

* * * * *